US008251642B2

(12) United States Patent
Hwang et al.

(10) Patent No.: US 8,251,642 B2
(45) Date of Patent: Aug. 28, 2012

(54) CENTRIFUGAL FAN

(75) Inventors: Ching-Bai Hwang, Taipei Hsien (TW); Zhi-Hui Zhao, Shenzhen (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 712 days.

(21) Appl. No.: 12/488,523

(22) Filed: Jun. 20, 2009

(65) Prior Publication Data

US 2010/0092282 A1 Apr. 15, 2010

(30) Foreign Application Priority Data

Oct. 13, 2008 (CN) ..... 2008 1 0304903

(51) Int. Cl.
*F04D 29/44* (2006.01)
*F04D 29/42* (2006.01)

(52) U.S. Cl. ..... 415/102; 415/119; 415/204; 415/206; 415/211.1; 415/214.1

(58) Field of Classification Search ..... 415/102, 415/119, 204, 206, 211.1, 211.2, 213.1, 214.1
See application file for complete search history.

(56) References Cited

U.S. PATENT DOCUMENTS

| | | | | |
|---|---|---|---|---|
| 6,142,732 | A * | 11/2000 | Chou et al. | 415/204 |
| 8,083,477 | B2 * | 12/2011 | Hwang et al. | 415/206 |
| 8,105,026 | B2 * | 1/2012 | Eguchi et al. | 415/204 |
| 2006/0099071 | A1 * | 5/2006 | Kao et al. | 415/206 |
| 2008/0019827 | A1 * | 1/2008 | Hirata | 415/206 |

FOREIGN PATENT DOCUMENTS

| | | | |
|---|---|---|---|
| CN | 1690918 | A | 11/2005 |
| CN | 2755321 | Y | 2/2006 |
| JP | 2008-280939 | A * | 11/2008 |

* cited by examiner

*Primary Examiner* — Christopher Verdier
(74) *Attorney, Agent, or Firm* — Altis Law Group, Inc.

(57) ABSTRACT

A centrifugal fan includes a top cover plate, a bottom plate, a sidewall and an impeller. The sidewall is defined with an air outlet. The impeller includes a hub and a plurality of blades extending radially outwardly from the hub. An air passage channel is defined between outmost free ends of the blades and an inner surface of the sidewall. A tongue is provided near the air outlet and protrudes inwardly and laterally from the inner surface of the sidewall towards the outmost free ends of the blades. The tongue has an outer surface facing the outmost free ends of the blades. A plurality of grooves is defined in the outer surface along a lengthwise direction of the tongue.

11 Claims, 4 Drawing Sheets

CENTRIFUGAL FAN

BACKGROUND

1. Technical Field

The present disclosure generally relates to centrifugal fans, and particularly to a centrifugal fan having a low noise during operation.

2. Description of Related Art

In a portable electronic device such as a notebook computer, a centrifugal fan is generally used to dissipate heat generated by heat-generating electronic components such as CPU (central processing unit) etc. The centrifugal fan typically includes a housing and an impeller rotatably received in the housing. The impeller includes a hub and a plurality of plate-type blades extending radially outwardly from the hub.

With continuing development of the electronic technology, the electronic components are made to operate at a high speed and therefore generate a large amount of heat required to be timely dissipated. In order to improve a heat dissipation efficiency of the centrifugal fan, a typical way is to increase a revolving speed of the impeller. However, increasing the revolving speed may correspondingly cause a rise of a noise level of the centrifugal fan, which makes a user near the centrifugal fan feel uncomfortable.

Therefore, it is desired to provide a centrifugal fan to overcome the above described shortcoming.

BRIEF DESCRIPTION OF THE DRAWINGS

Many aspects of the present disclosure can be better understood with references to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
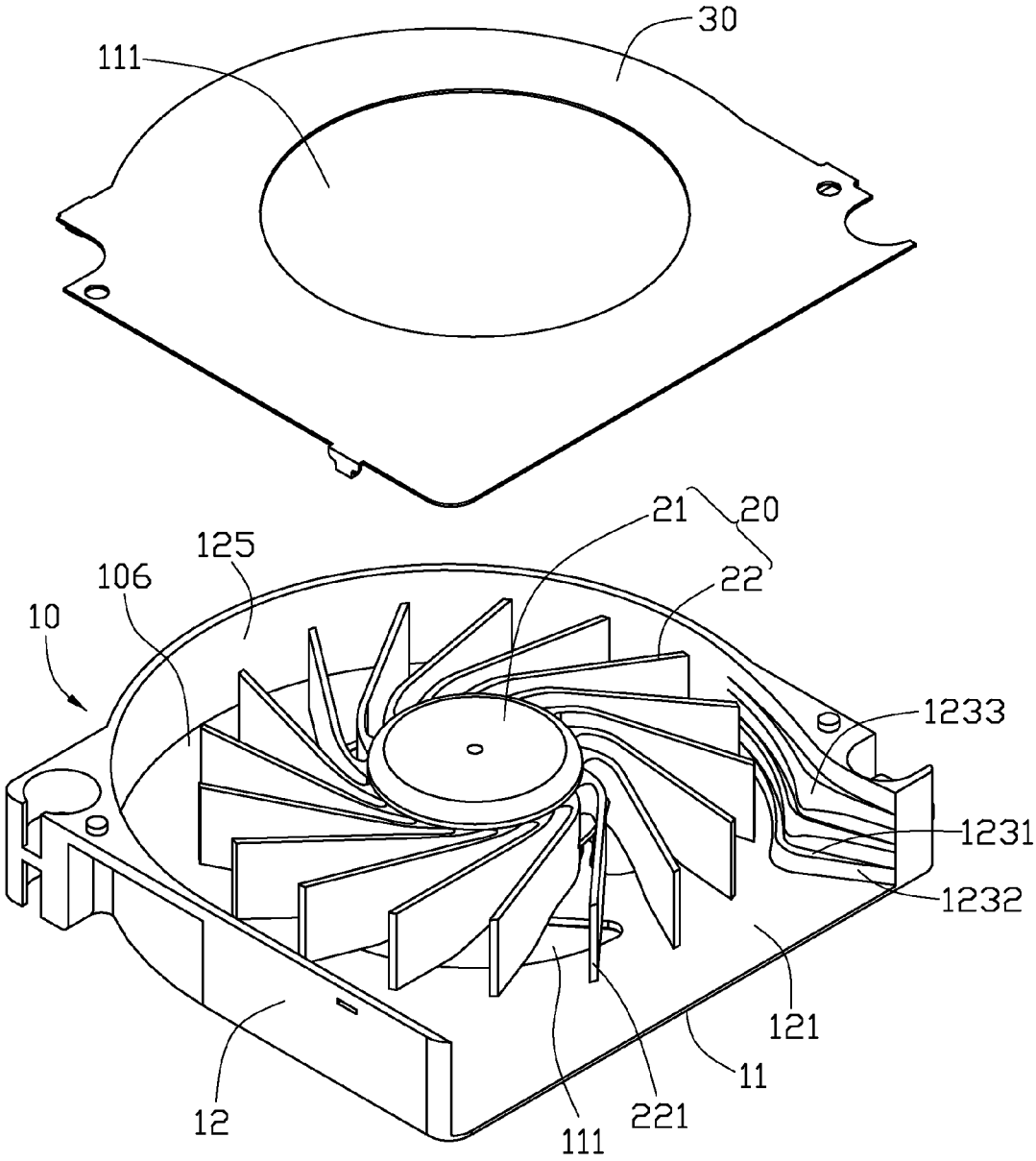
FIG. 1 is an exploded, isometric view of a centrifugal fan in accordance with an exemplary embodiment of the present disclosure.

Referring to FIG. 1, a centrifugal fan according to an exemplary embodiment of the present disclosure is shown. The centrifugal fan is used to dissipate heat of heat-generating electronic components such as CPUs in portable electronic devices such as notebook computers, etc. The centrifugal fan includes a bottom seat 10, a top cover plate 30 and an impeller 20. The bottom seat 10 includes a bottom plate 11 opposite to top cover plate 30 and a volute sidewall 12 extending perpendicularly upwardly from an outer periphery of the bottom plate 11 towards the top cover plate 30. Each of the bottom plate 11 and the top cover plate 30 is defined with an air inlet 111 through a central portion thereof. An air outlet 121 is defined in the sidewall 12. The air inlets 111 are perpendicular to the air outlet 121. The bottom plate 11, the top cover plate 30 and the sidewall 12 cooperatively form a housing for the centrifugal fan, and the impeller 20 is rotatably received in a receiving space 115 (FIG. 4) defined by the housing.

The impeller 20 includes a hub 21 and a plurality of blades 22 extending radially outwardly from the hub 21. A volute air passage channel 106 is defined between outmost free ends 221 of the blades 22 and an inner surface 125 of the sidewall 12. In the embodiment, the impeller 20 rotates counter-clockwise, as viewed from FIG. 1. A width of the air passage channel 106 gradually increases along a rotation direction of the impeller 20, i.e., counter-clockwise direction.

Figure 2:
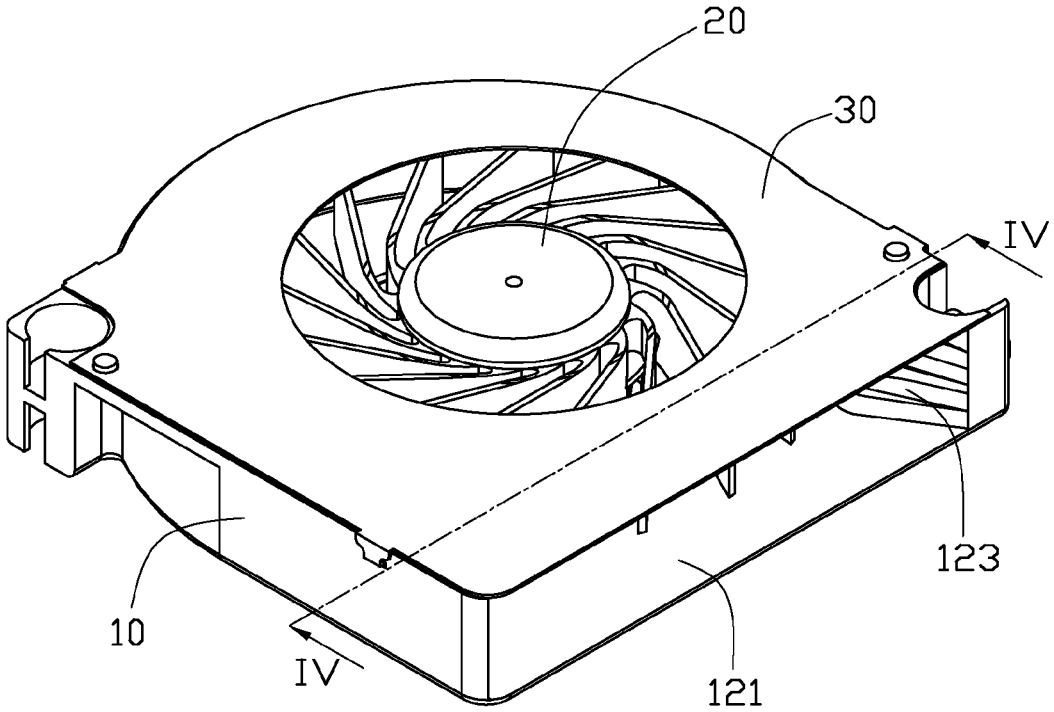
FIG. 2 is an assembled, isometric view of the centrifugal fan of FIG. 1.
Figure 3:
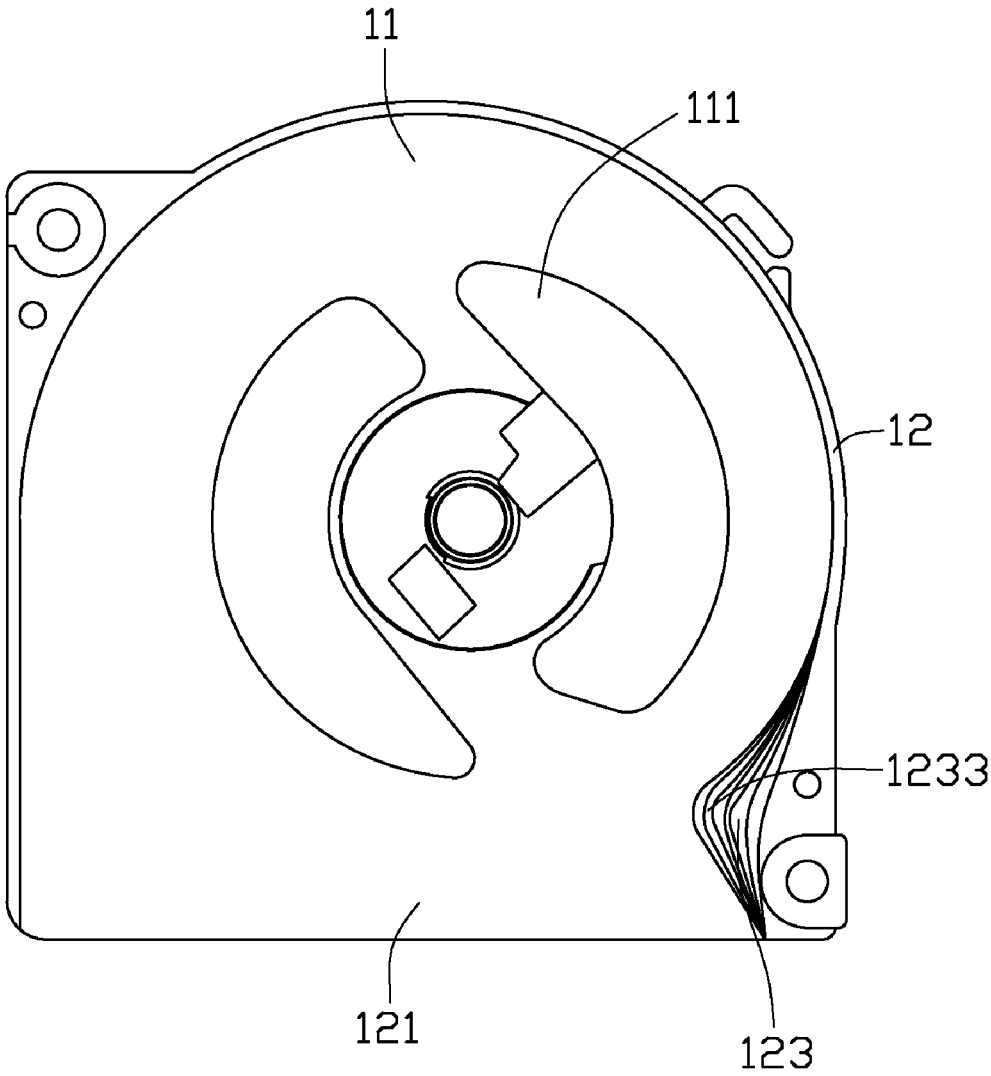
FIG. 3 is a plan view of a bottom seat of the centrifugal fan of FIG. 1.
Figure 4:
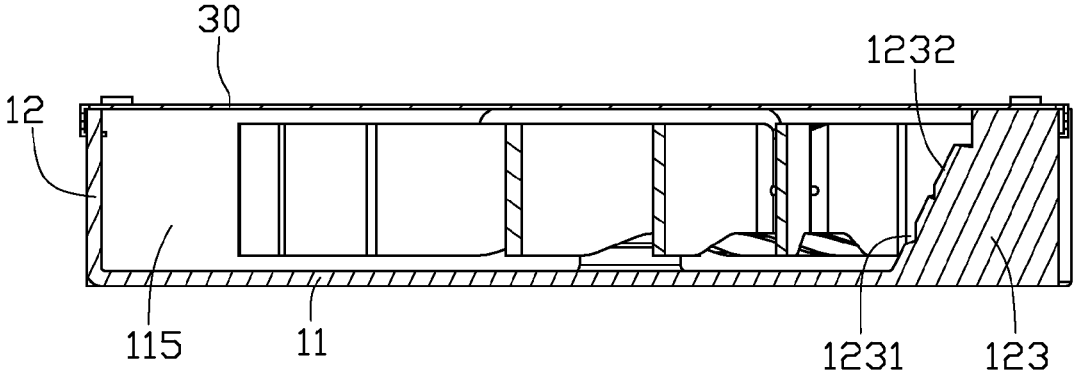
FIG. 4 is a cross-sectional view of the centrifugal fan of FIG. 2, taken along line IV-IV thereof.

Referring also to FIGS. 2-4, the sidewall 12 is formed with a tongue 123 near the air outlet 121. The tongue 123 protrudes laterally and inwardly from the inner surface 125 of one end (i.e., right end of FIG. 1) of the sidewall 12 towards the outmost free ends 221 of the blades 20 and toward an opposite end (i.e., left end of FIG. 1) of the sidewall 12. Furthermore, the tongue 123 extends lengthwise and inwardly from an outer edge of the one end (i.e., the right end) of the sidewall 12 into the air passage channel 106. The tongue 123 has a curved outer surface 1232 facing the outmost free ends 221 of the blades 22 and slantingly arranged with respect to the bottom plate 11. A size of a transverse cross section of the tongue 123 gradually increases along a height direction of the tongue 123 from the top cover plate 30 towards the bottom plate 11.

A plurality of grooves 1231 is evenly defined in the outer surface 1232 along the height direction of the tongue 123. Each of the grooves 1231 extends along a lengthwise direction of the tongue 123. The grooves 1231 are parallel to the bottom plate 11 and spaced from each other. Each of the grooves 1231 extends from an outer end of the tongue 123 which is located adjacent to the air outlet 121 towards an inner end of the tongue 123 which is smoothly connected with the inner surface 125 of the sidewall 12. The tongue 123 has a bulge 1233 at a middle portion thereof, wherein the bulge 1233 is located closer to the outmost free ends 221 of the blades 22 than other portions of the tongue 123. A thickness of the tongue 123 decreases gradually from the bulge 1233 towards the inner and the outer ends of the tongue 123 along the lengthwise direction of the tongue 123, and decreases gradually from the bottom plate 11 towards the top cover plate 30 along the height direction of the tongue 123. Accordingly, a distance between the outer surface 1232 of the tongue 123 and the outmost free ends 221 of the blades 22 increases gradually from the bulge 1233 towards the inner and the outer ends of the tongue 123 along the lengthwise direction of the tongue 123, and increases gradually from the bottom plate 11 towards the top cover plate 30 along the height direction of the tongue 123. A minimum distance between the outer surface 1232 of the tongue 123 and the outmost free ends 221 of the blades 22 is formed between a portion of the bulge 1233 adjacent to the bottom plate 11 and the outmost free ends 221 of the blades 20.

In operation, the impeller 20 rotates and the blades 22 drive an airflow into the air passage channel 106 via the air inlets 111. The airflow is guided by the inner surface 125 of the sidewall 12 to flow along the air passage channel 106 from the tongue 123 towards the air outlet 121. Specifically, the airflow firstly flows into the air passage channel 106 along the outer surface 1232 of the tongue 123, then towards the air outlet 121 along the air passage channel 106, and finally to an outside of the centrifugal fan via the air outlet 121. Since the tongue 123 is protruded towards the outmost free ends 221 of the blades 20, an air pressure of the airflow entering into the air passage channel 106 is greatly increased. When the airflow blows on different points of the outer surface 1232 of the tongue 11, each blown point is a sound source which will generate a narrowband noise. However, due to the presence of the grooves 1231 on the curved outer surface 1232 of the tongue 123, the narrowband noises at different blown points are disturbed to have different frequencies and will not be superposed. Thus, the noise level of the present centrifugal fan is greatly reduced.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A centrifugal fan, comprising:

a top cover plate;

a bottom plate opposite to the top cover plate, the top cover plate and the bottom plate each being defined with an air inlet;

a sidewall between the bottom plate and the top cover plate, the sidewall being defined with an air outlet, the air outlet being perpendicular to the air inlets of the top cover plate and the bottom plate; and an impeller being rotatably received in a receiving space cooperatively defined by the top cover plate, the bottom plate and the sidewall, the impeller comprising a hub and a plurality of blades extending radially outwardly from the hub, an air passage channel being defined between outmost free ends of the blades and an inner surface of the sidewall, a tongue being provided near the air outlet and protruding laterally and inwardly from the inner surface of the sidewall towards the outmost free ends of the blades, the tongue having an outer surface facing the outmost free ends of the blades, a plurality of grooves being defined in the outer surface along a lengthwise direction of the tongue;

wherein the tongue has a bulge at a middle portion thereof, and the bulge is located closer to the outmost free ends of the blades than other portions of the tongue;

wherein the outer surface of the tongue is curved and a thickness of the tongue with respect to the sidewall decreases gradually from the bulge towards the inner and the outer ends of the tongue along the lengthwise direction of the tongue, and decreases gradually from the bottom plate towards the top cover plate along the height direction of the tongue; and wherein a distance between the outer surface of the tongue and the outmost free ends of the blades increases gradually from the bulge towards the inner and the outer ends of the tongue along the lengthwise direction of the tongue, and increases gradually from the bottom plate towards the top cover plate along the height direction of the tongue.

2. The centrifugal fan of claim 1, wherein the outer surface of the tongue is slantingly arranged with respect to the bottom plate.

3. The centrifugal fan of claim 2, wherein a size of a transverse cross section of the tongue gradually increases along a height direction of the tongue from the top cover plate towards the bottom plate.

4. The centrifugal fan of claim 1, wherein the grooves are parallel to the bottom plate and spaced from each other.

5. The centrifugal fan of claim 1, wherein each of the grooves extends from an outer end of the tongue which is adjacent to the air outlet towards an inner end of the tongue which is smoothly connected with the inner surface of the sidewall.

6. The centrifugal fan of claim 1, wherein a minimum distance between the outer surface of the tongue and the outmost free ends of the blades is formed between a portion of the bulge adjacent to the bottom plate and the outmost free ends of the blades.

7. The centrifugal fan of claim 1, wherein the impeller drives airflow into the air passage channel via the air inlet, the airflow is guided by the inner surface of the sidewall to flow along the air passage channel from the tongue towards the air outlet.

8. The centrifugal fan of claim 7, wherein the airflow firstly flows into the air passage channel along the outer surface of the tongue, then towards the air outlet along the air passage channel, and finally to an outside of the centrifugal fan via the air outlet.

9. The centrifugal fan of claim 1, wherein a width of the air passage channel gradually increases along a rotation direction of the impeller.

10. The centrifugal fan of claim 1, wherein the grooves are parallel to the bottom plate and evenly arranged in the outer surface of the tongue along a height direction of the tongue.

11. A centrifugal fan, comprising:

a top cover plate defining an air inlet therein;

a bottom plate opposite to the top cover plate, the bottom plate defining an air inlet therein;

a sidewall between the bottom plate and the top cover plate, the sidewall defining an air outlet therein, the air outlet being perpendicular to the air inlets of the top cover plate and the bottom plate; and an impeller being rotatably received in a receiving space cooperatively defined by the top cover plate, the bottom plate and the sidewall, the impeller comprising a hub and a plurality of blades extending radially outwardly from the hub, an air passage channel being defined between outmost free ends of the blades and an inner surface of the sidewall, a tongue being provided near the air outlet and protruding laterally and inwardly from the inner surface of the sidewall towards the outmost free ends of the blades, the tongue having an outer surface facing the outmost free ends of the blades, a plurality of grooves being defined in the outer surface along a lengthwise direction of the tongue;

wherein the tongue has a bulge at a middle portion thereof, and the bulge is located closer to the outmost free ends of the blades than other portions of the tongue;

wherein the outer surface of the tongue is curved and a thickness of the tongue with respect to the sidewall decreases gradually from the bulge towards the inner and the outer ends of the tongue along the lengthwise direction of the tongue, and decreases gradually from the bottom plate towards the top cover plate along the height direction of the tongue; and wherein a minimum distance between the outer surface of the tongue and the outmost free ends of the blades is formed between a portion of the bulge adjacent to the bottom plate and the outmost free ends of the blades.

* * * * *